US005769136A

United States Patent [19]

Kanematsu et al.

[11] Patent Number: 5,769,136

[45] Date of Patent: Jun. 23, 1998

[54] LIQUID METERING-FILLING APPARATUS

[75] Inventors: Toshio Kanematsu; Yoshihiro Saijo; Michio Ueda, all of Tokushima, Japan

[73] Assignee: Shikoku Kakoki Co., Ltd., Tokushima, Japan

[21] Appl. No.: 754,590

[22] Filed: Nov. 20, 1996

[30] Foreign Application Priority Data

Nov. 22, 1995 [JP] Japan ..... 7-304020

[51] Int. Cl.[6] ..... B65B 1/04

[52] U.S. Cl. ..... 141/129; 141/140; 141/156; 141/258; 222/504

[58] Field of Search ..... 141/129, 140–143, 141/156–162, 178, 179, 191, 192, 127, 258–262; 222/380, 504, 495–497; 137/624.12

[56] References Cited

U.S. PATENT DOCUMENTS

| | | | |
|---|---|---|---|
| 3,489,186 | 1/1970 | Riker . | |
| 3,934,625 | 1/1976 | Tiernan et al. . | |
| 4,060,106 | 11/1977 | Takasuga . | |
| 4,359,075 | 11/1982 | Eberle et al. | 141/177 |
| 4,491,159 | 1/1985 | Colacci . | |
| 4,522,238 | 6/1985 | Minard . | |
| 4,925,069 | 5/1990 | Ueda et al. | 141/258 |
| 4,982,770 | 1/1991 | Saijo et al. | 141/258 |
| 5,035,270 | 7/1991 | Herzog | 141/258 |

FOREIGN PATENT DOCUMENTS

| | | |
|---|---|---|
| 0 402 535 | 12/1990 | European Pat. Off. . |
| 0 576 987 A1 | 1/1994 | European Pat. Off. . |
| 1 381 122 | 1/1975 | United Kingdom . |

*Primary Examiner*—Henry J. Recla
*Assistant Examiner*—Steven O. Douglas
*Attorney, Agent, or Firm*—Armstrong, Westerman, Hattori, McLeland & Naughton

[57] ABSTRACT

A liquid metering-filling apparatus is provided which includes a container transport conveyor intermittently drivable so as to halt containers one by one at a filling station. A filling nozzle is disposed above a path of transport of containers at the filling station. A metering cylinder houses a piston and has an outlet in communication with the filling nozzle. An inlet check valve is provided at an inlet of the metering cylinder. An outlet check valve is provided at any one of the outlet of the metering cylinder and inside of the filling nozzle. The liquid metering-filling apparatus also includes a driver for causing the piston to perform a cycle of stroking movement every time the conveyor is driven by one pitch. A photoelectric sensor is provided at the filling station for detecting any one of the presence and absence of a container of the plurality of containers at the filling station. A photoelectric sensor is provided at a stop station for detecting any one of the presence and absence of a container of the plurality of containers at the stop station which is immediately preceding the filling station upstream therefrom. The liquid metering-filling apparatus also includes a valve opening-closing member for opening the inlet check valve upon the photoelectric sensor at the filling station detecting the absence of a container of the plurality of containers and the photoelectric sensor at the stop station detecting the presence of a container of the plurality of containers.

6 Claims, 4 Drawing Sheets

LIQUID METERING-FILLING APPARATUS

BACKGROUND OF THE INVENTION

The present invention relates to liquid metering-filling apparatus for use in filling containers with a liquid such as fluid food.

As disclosed, for example, in Japanese Utility Model Publication No. 6081/1995, such liquid metering-filling apparatus already known comprise a container transport conveyor intermittently drivable so as to half containers one by one at a filling station, a filling nozzle disposed above the path of transport of containers at the filling station, a metering cylinder housing a piston and hating an outlet in communication with the filling nozzle, an inlet check valve provided at the inlet of the metering cylinder, an cutlet check valve provided at the outlet of the metering cylinder or in the interior of the filling nozzle, and drive means for causing the piston to perform a cycle of stroking movement every time the conveyor is driven by one pitch.

When no container is present at the filling station, the piston is brought to a halt to discontinue the filling operation with the nozzle and the metering cylinder filled with the liquid to be filled into the container. When the piston at rest resumes its filling operation, there is a tendency for the piston to fill a greater amount of liquid by the first cycle of filling operation than by a continual operation in a steady state. The increase in the amount is about 5 to 10 c.c. in the case where the container has a capacity of 1000 c.c. The increase is attributable to the fact that when the piston at rest at the end of its stroke starts to stroke, the mechanical play or backlash of the drive means results in a corresponding increase in the piston stroke.

SUMMARY OF THE INVENTION

An object of the present invention is to overcome the above problem and to provide a liquid metering-filling apparatus which is prevented from filling a greater amount of liquid than is specified when performing the first cycle of filling operation upon resuming the operation after an interruption.

The present invention provides a liquid metering-filling apparatus comprising a container transport conveyor intermittently drivable so as to halt containers one by one at a filling station, a filling nozzle disposed above a path of transport of containers at the filling station, a metering cylinder housing a piston and having an outlet in communication with the filling nozzle, an inlet check valve provided at an inlet of the metering cylinder, an outlet check valve provided at the outlet of the metering cylinder or inside the filling nozzle, and drive means for causing the piston to perform a cycle of stroking movement every time the conveyor is driven by one pitch, the metering-filling apparatus being characterized in that the apparatus comprises first sensor means for detecting presence or absence of the container at the filling station, second sensor means for detecting presence or absence of the container at a stop station immediately preceding the filling station upstream therefrom, and valve opening-closing means for opening the inlet check valve upon the first sensor means detecting the absence of the container and the second sensor means detecting the presence of the container.

When the inlet check valve is opened in the liquid metering-filling apparatus embodying the invention, the liquid to be filled into containers and flowing into the metering cylinder through the inlet flows out from the cylinder through the inlet instead of being admitted into the filling nozzle, se that the filling operation can be interrupted without causing the piston to cease stroking. Accordingly, in the case where the container is present at the upstream stop station immediately preceding the filling station with no container present at the filling station, the likelihood of the piston filling an increased amount of liquid by its stroke when initiated into filling operation can be avoided by causing the piston to stroke before starting the operation to thereby eliminate backlash or the like.

When the apparatus is provided with valve opening-closing means for forcedly closing the outlet check valve while the inlet check valve is open, leakage of the liquid from the outlet check valve can be prevented.

Preferably, the liquid metering-filling apparatus has means for controlling the drive means so as to stop the operation of the drive means upon the first sensor means detecting the absence of the container and the second sensor means detecting the absence of the container.

In the case where the container is present neither of the filling station and the upstream stop station immediately preceding the filling station, the piston is brought to a halt to thereby discontinue the filling operation.

Preferably, the drive means comprises a pivotal cam follower having a drive arm and a driven arm with one end of the drive arm connected to the piston, a plate cam having a cam contour face adapted for bearing contact with one end of the driven arm, a hydraulic cylinder having a piston rod for biasing the cam follower so as to move said end of the driven arm toward the cam contour face when the piston rod is retracted and to move said driven arm end away from the cam contour face when the piston rod is advanced, and a stopper permitting a required portion of the cam follower to come into contact with the stopper when the cam follower is pivotally moved in a direction in which said driven arm end moves away from the cam contour face, said driven arm end being in contact with or spaced apart by a small clearance from a portion of the cam contour face having the largest radius when the cam follower is in contact with the stopper.

Under the control of the control means, the piston rod is retracted when the drive means is operated and the piston rod is advanced when the drive means is brought out of operation.

The piston of the metering cylinder is brought to a halt or caused to resume its stroking movement by the simple procedure of merely advancing or retracting the piston rod of the hydraulic means.

DESCRIPTION OF THE PREFERRED EMBODIMENT

An embodiment of the invention will be described below with reference to the drawings.

Figure 1:
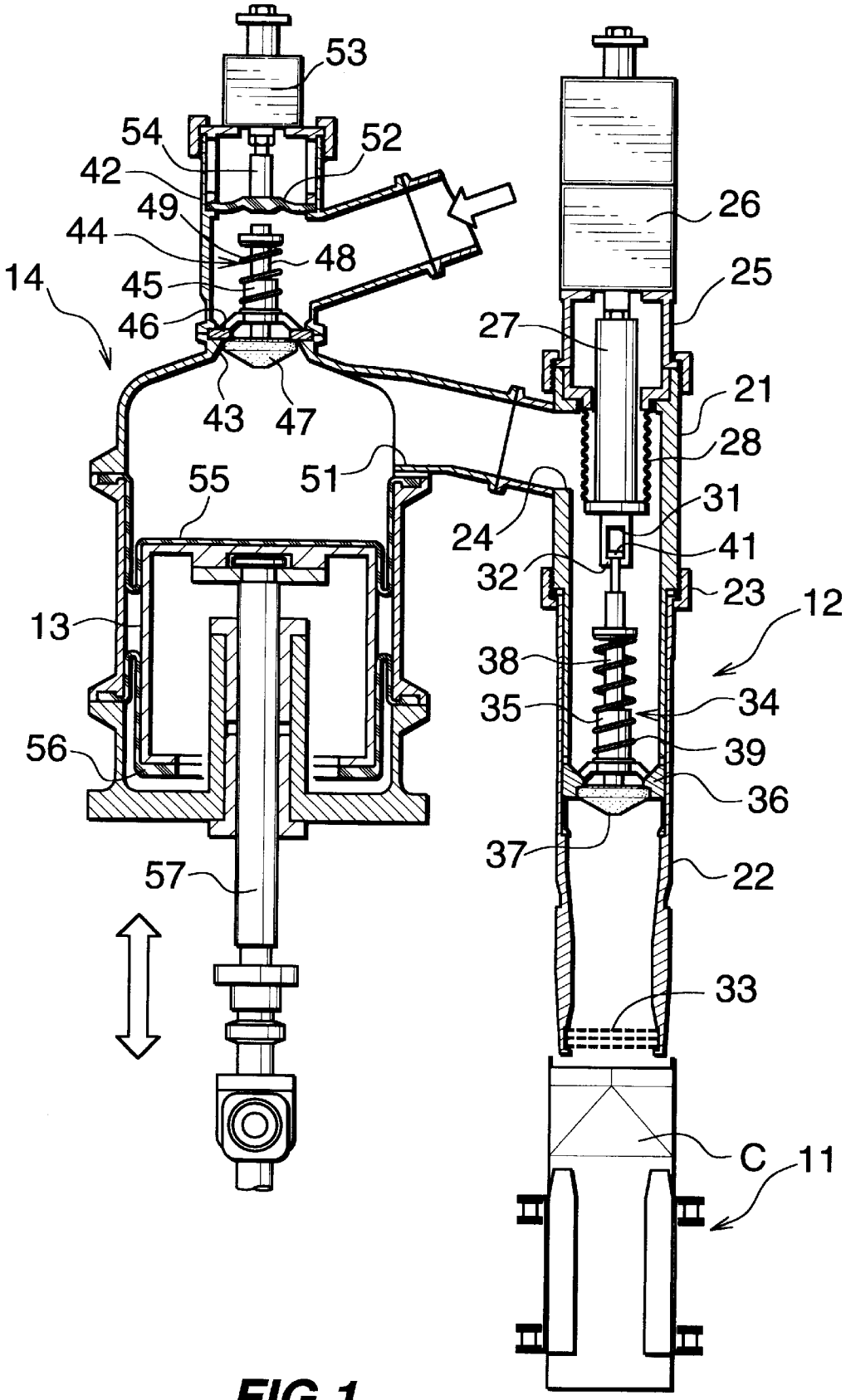
FIG. 1 is a longitudinal view in vertical section of a filling nozzle and a metering cylinder of a filling apparatus embodying the invention.

FIG. 1 shows a liquid metering-filling apparatus which comprises a container transport conveyor 11 intermittently drivable so as to halt containers C thereon one by one at a filling station, a vertical tubular filling nozzle 12 disposed above the path of transport of containers at the filling station, a metering cylinder 14 housing a piston 13 and disposed in parallel to the nozzle 12.

The filling nozzle 12 comprises an upper member 21 and a lower member 22, which are detachably joined by a cap nut 23.

The peripheral wall of the upper member 21 is formed with an inlet 24 at an intermediate portion of its height. A hydraulic cylinder 26 with a two-step stroke for operating a lower check valve 34 is attached, as directed downward, to the upper end of the upper member 21 by a tubular yoke 25. A vertical rod 27 is connected to the piston rod of the hydraulic cylinder 26. The rod 27 has a lower portion extending into the upper member 21. A tubular bellows member 28 is provided for sealing between the vertical rod 27 and an opening inner periphery of the upper end of the upper member 21. An upward slit 31 is formed in the lower end of the vertical rod 27 to provide at the lower end a pair of opposed engaging projections 31 each having an engaging upper face.

The lower member 22 has a lower-end opening provided with a strainer 33 of metal netting. The lower member 22 has above-mentioned lower check valve 34 at the midportion of its height.

The lower check valve 34 comprises a seat ring 36 facing down and provided with a vertical tubular stem guide 35, a valve disk 37 movable into intimate contact with the seat ring 36 from below, a vertical rodlike stem 38 extending from the valve disk 37 upward through the stem guide 35, and a coiled compression spring 39 provided around the stem 38 and biasing the stem 38 upward. Formed at the upper end of the stem 38 is an engaging projection 41 in the form of a flange, fitted in the slit 31 and having a lower face engageable with the projection 32 from above.

The metering cylinder 14 has a top wall which is centrally formed with an inlet 43 communicating via a vertical connecting tube 42 with a tank (not shown) containing the liquid to be filled. The inlet 43 is provided with an upper check valve 44.

The upper check valve 44, which has the same construction as the lower check valve 34, comprises a seat ring 46 carrying a stem guide 45, valve disk 47, stem 48 and coiled compression spring 49.

The peripheral wall of the metering cylinder 14 is formed at its upper end with an outlet 51 communicating with the inlet 24 of the filling nozzle 12. A diaphragm 52 of elastic material is disposed slightly above the upper end of the stem 48 within the connecting tube 42 transversely thereof. A hydraulic cylinder 53 for operating the upper check valve 44 is mounted as directed downward on the upper end of the connecting tube 42. A vertical rod 54 is connected to the piston rod of the hydraulic cylinder 53 and has a lower end attached to the center of the upper surface of the diaphragm 52.

A clearance is formed between the peripheral wall of the metering cylinder 14 and the piston 13. The clearance is closed at its upper and lower ends with respective diaphragms 55, 56 of elastic material. The piston 13 has connected thereto the upper end of a vertical piston rod 57 extending downward through the bottom wall of the metering cylinder 14.

Figure 2:
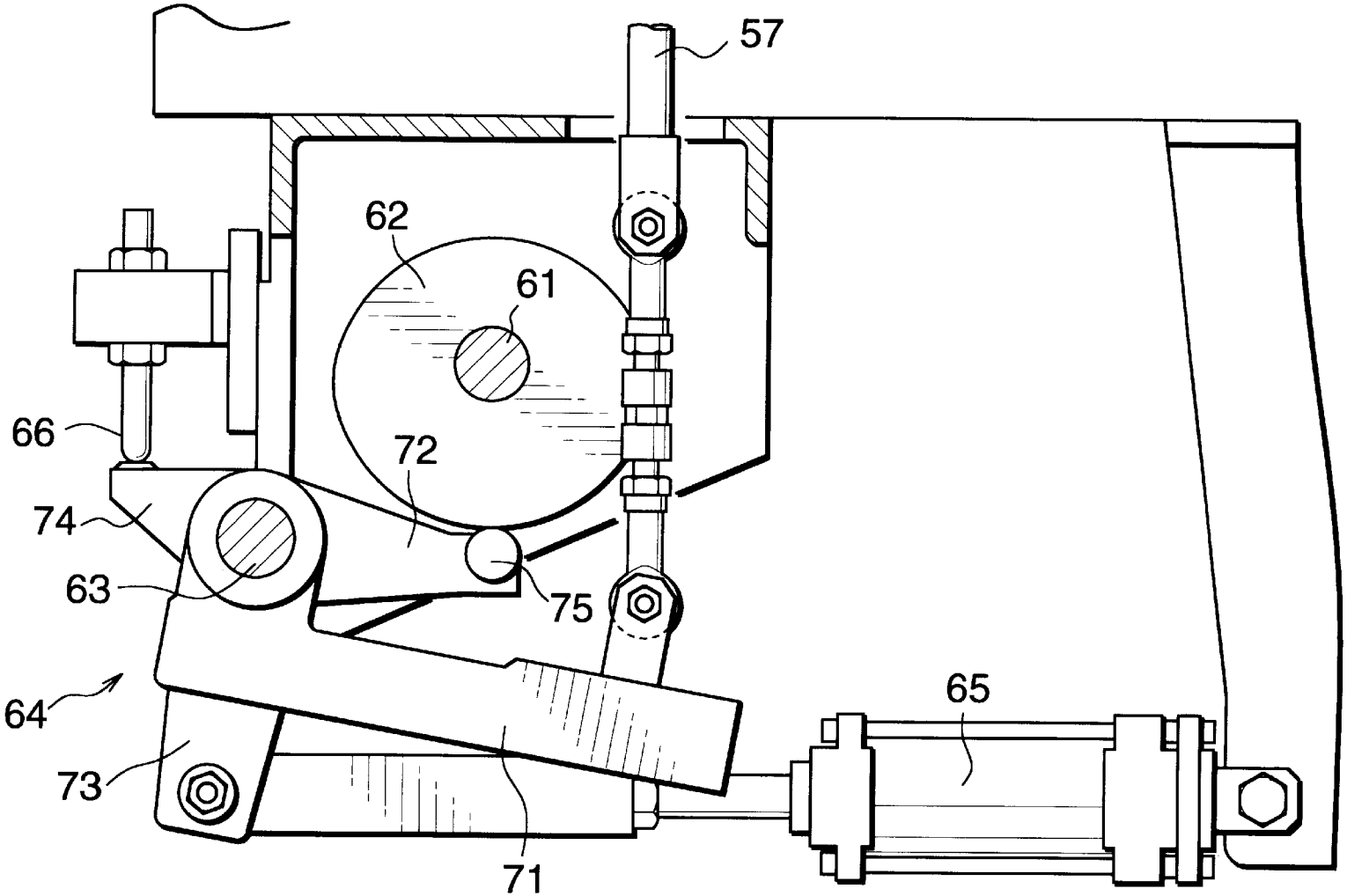
FIG. 2 is a side elevation showing a drive mechanism of the filling apparatus.

FIG. 2 shows a drive mechanism for causing the piston 13 of the metering cylinder 14 to stroke.

The drive mechanism comprises a horizontal cam shaft 61 disposed below the metering cylinder 14, a plate cam 62 fixed to the cam shaft 61 and having a cam contour face on its outer periphery, a cam follower 64 supported by a horizontal shaft 63 parallel to the cam shaft 61 and pivotally movable upward and downward by the plate cam 62, a hydraulic cylinder 65 for restraining the cam follower 64, and a vertical rodlike stopper 66 disposed above the cam follower 64 for limiting the movement of the cam follower 64 so as not to permit the follower 64 to follow the plate cam 62.

The cam follower 64 comprises a first arm 71 connected to the piston rod 57 of the metering cylinder 14, a second arm 72 extending in the same direction as the first arm 71 thereabove and bearing against the lower end of the plate cam 62, a third arm 73 extending downward from a base portion of the first arm 71 and connected to the piston rod of the hydraulic cylinder 65, and a fourth arm 74 extending in a direction opposite to the second arm 72 and having one end in contact with the lower end of the stopper 66. The second arm 72 carries a roller 75 at one end thereof.

The piston 13 of the metering cylinder 14 is at rest in the state shown in FIG. 2. The piston rod of the hydraulic cylinder 65 is in an advanced position, biasing the cam follower 64 clockwise in FIG. 2 for pivotal movement and holding the follower 64 in bearing contact with the stopper 66. The plate cam 62 has a portion of the largest radius directed downward. The portion of the largest radius is in contact with the roller 75 or spaced apart therefrom by a very small clearance. Even if the plate cam 62 is in rotation, therefore, the cam follower 64 is unlikely to move pivotally, holding the piston 13 of the metering cylinder 14 at rest without stroking. This is the state of waiting for filling.

When the piston rod of the hydraulic cylinder 65 is retracted from the state shown in FIG. 2, the cam follower 64 is biased into counterclowise movement in FIG. 2 with the roller 75 pressed against the plate cam 62 and is moved pivotally following the cam 62.

With one turn of rotation of the plate cam 62 bringing the portion of the largest radius directed downward to this position again, the cam follower 64 pivotally moves once, causing the piston 13 of the metering cylinder 14 to make a cycle of reciprocation from the lower-limit position of its stroke.

The piston 13 of the metering cylinder 14 is caused to stroke for the two modes of operation, i.e., for usual filling and for idle filling. The term "usual filling" refers to a continual filling operation. The term "idle filling" refers to the case wherein the piston 13 of the metering cylinder 14 is allowed to stroke without discharging the fluid from the filling nozzle 12.

Figure 3:
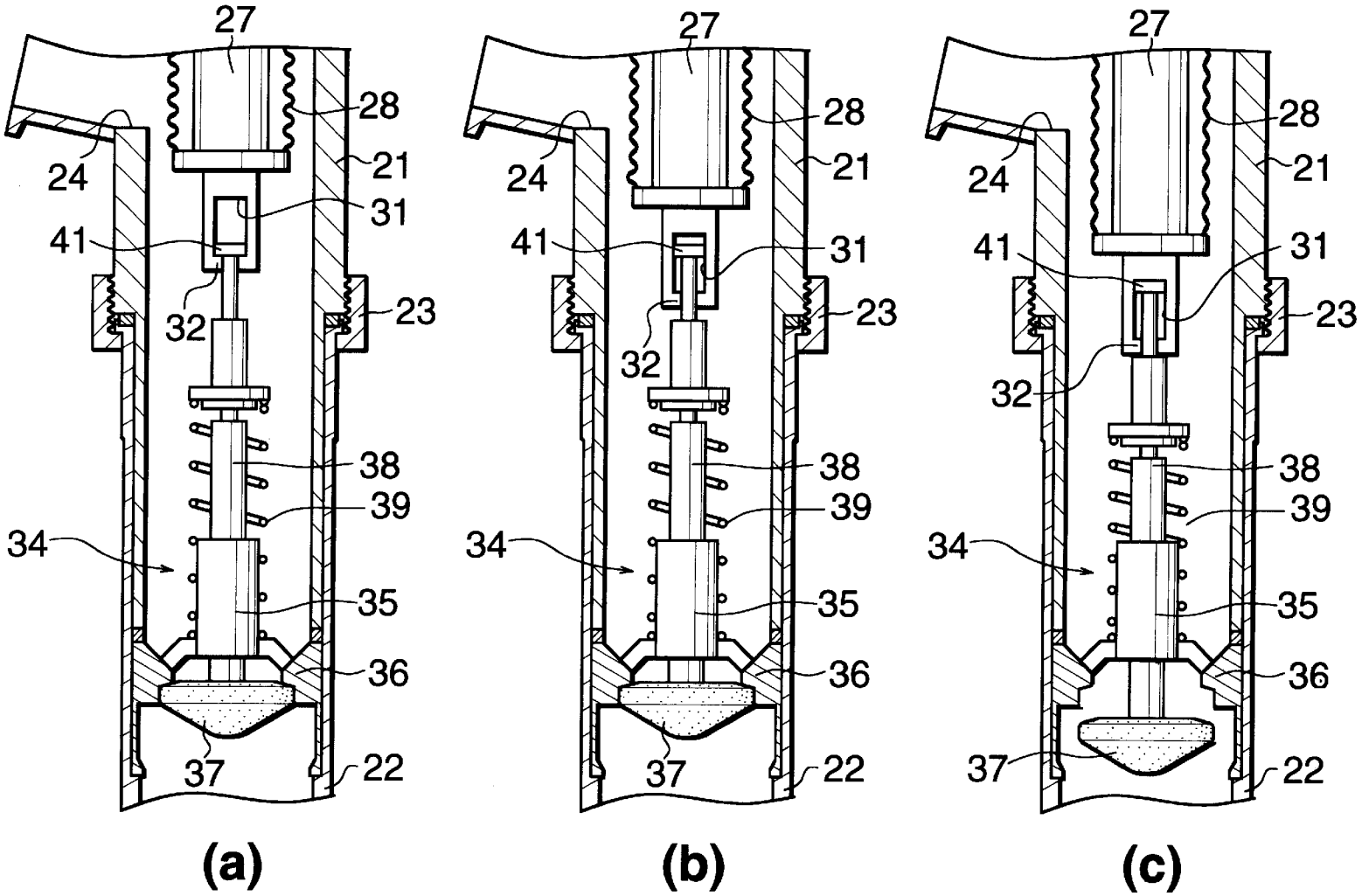
FIGS. 3(*a*)–(*c*) are diagrams for illustrating the operation of an outlet check vale of the filling apparatus.

For usual filling, the piston rod of the hydraulic cylinder 53 is retracted as shown in FIG. 1, causing the force of the spring 49 only to press the valve disk 47 of the upper check valve 44 against the seat ring 46. The piston rod of the hydraulic cylinder 26 is advanced by the first-step stroke as shown in FIG. 3(*b*) to produce a space between the engaging projections 32 and 41, rendering the stem 38 of the lower check valve 34 movable upward and downward a distance corresponding to the space.

When the piston 13 of the metering cylinder 14 ascends from the lower limit of its stroke, the lower check valve 34 is opened although the upper check valve 44 is held closed, whereby the liquid within the metering cylinder 14 is sent into the filling nozzle 12, causing an amount of liquid corresponding to the amount of liquid sent in to flow out from the lower-end opening of the filling nozzle 12. When the piston 13 of the metering cylinder 14 descends from the stroke upper limit, the upper check valve 44 is opened, allowing another portion of liquid to flow into the metering cylinder 14 in preparation for the next cycle.

In the case of idle filling, the piston rod of the hydraulic cylinder 53 is advanced, forcing the stem 48 of the upper check valve 44 down to open the upper check valve 44. On the other hand, the piston rod of the hydraulic cylinder 26 for the lower check valve is retracted. In this state, the engaging projections 32 and 41 are in engagement, holding the stem 38 of the lower check valve 34 pulled up and forcedly pressing the valve disk 37 against the seat ring 36 by the hydraulic pressure of the cylinder 26 as seen in FIG. 3(*a*).

While the upper check valve 44 is open with the lower check valve 34 forcedly closed, the liquid within the metering cylinder 14 flows out from the inlet 43 even if the piston 13 of the metering cylinder 14 rises from the stroke lower limit, with the result that no liquid is sent into the filling nozzle 12, hence no filling operation.

Further when the piston rod of the hydraulic cylinder 26 for the lower check valve 34 is advanced by the second-step stroke, forcedly leaving the valve 34 left open as shown in FIG. 3(*c*), the filling apparatus can be drained of the liquid.

For example, the connection of components of the drive mechanism involves mechanical play or backlashes. During the usual filling operation, the descent of the piston 13 of the metering cylinder 13 produces pronounced backlashes, while the ascent of the piston produces diminished backlashes. This results in a constant piston stroke. If the piston 13 of the metering cylinder 14 is at rest at the stroke lower limit while waiting for filling, the backlash increased by the descent of the piston 13 is diminished under gravity acting on the piston 13, etc. in the meantime. When the piston 13 is raised from this state for the start of filling, the piston 13 ascends in the first cycle to excess by an amount corresponding to the backlash, consequently entailing an increase in the amount of liquid filled.

Further if here is a clearance between the cam contour face of the plate can 62 and the roller 75 during waiting for filling, the piston 13 will stroke excessively by an amount corresponding to the clearance. This also results in an increase in the amount of liquid to be filled.

The filling operation is conducted with such an increase avoided in the amount of liquid as will be described below with reference to FIG. 4.

A photoelectric sensor 81 for detecting the presence or absence of the container C on the conveyor 11 is disposed at a container feed station (not shown) at the starting end of the path of transport by the conveyor. The container feed station is disposed upstream from the filling station with a predetermined number of pitches of transporting the container C. One pitch of transporting the container C is defined as the distance the container C is transported by one cycle of the intermittent drive conveyor. The output of the sensor 81 is fed to an arithmetic unit (sequencer) 82. The sensor 81 is disposed at the container feed station so as to detect the presence or absence of the container which is fed to this station every time the conveyor moves one cycle. The arithmetic unit has a counter and a memory. A signal of the presence or absence of the container C detected by the sensor is sent to the arithmetic unit every time the detection is conducted. The signal sent to the arithmetic unit is counted by the counter so that the signal is stored at a corresponding address of the memory one by one every time the counting is conducted. The signals input are stored successively as items of data in the unit 82. The presence or absence of the container C at a stop station, i.e. a preparatory station, immediately preceding the filling station upstream therefrom is detected based on the data, and a control command is subsequently output based on the result of detection. The filling apparatus is controlled in accordance with the command. Assuming that the container feed station and the filling station are disposed with a distance of 10 pitches of transporting the container C therebetween and that the sensor 81 outputs a signal and simultaneously a signal is stored in the memory 10 times of counting prior to the present signal is read out. The signal which is read out is a signal detected by the sensor at the container feed station when the container presently located on the filling station was located on the container feed station. Therefore, whenever the sensor outputs a signal, the signal counted 10 times of counting prior to the present signal is read out from the corresponding address and determines the presence or absence of the container C presently at the filling station. Similarly, the presence or absence of the container is determined at the stop station immediately preceding the filling station upstream therefrom by reading out a signal 9 times of counting prior to the present signal.

Figure 4:
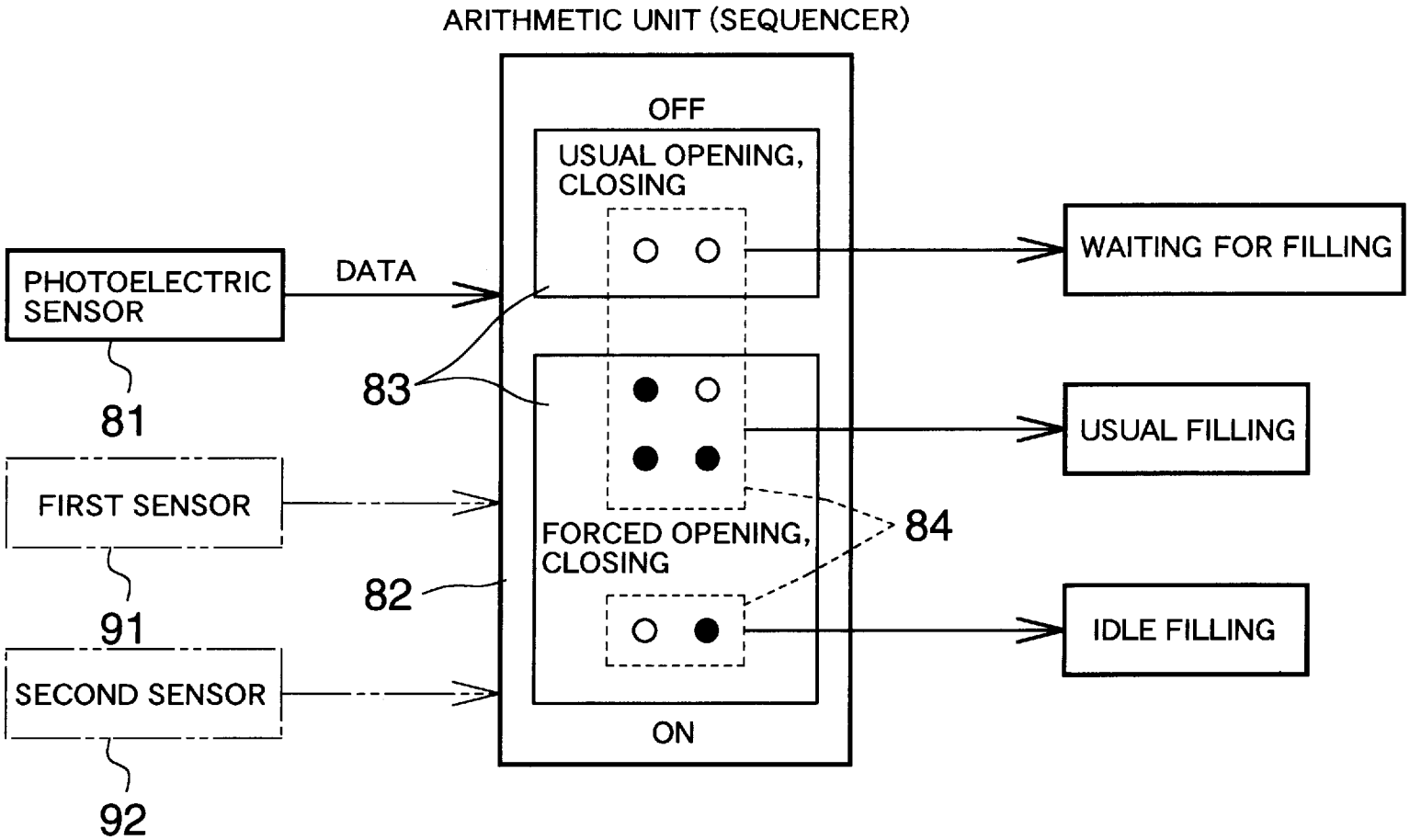
FIG. 4 is a block diagram showing how to control the filling operation of the apparatus.

In the largest frame representing the arithmetic unit 82 in FIG. 4, each solid circular mark stands for presence of container, and each blank circular mark for the absence of container. Of the right and left two columns of containers, the left column indicates the presence or absence of container at the filling station, and the right column indicates the presence or absence of container at the preparatory station. The solid-line frames 83 within the above frame show on-off state of the drive mechanism, and dotted-line frames 84 the operating state of the upper and lower check valves 34, 44.

When the absence of container is detected at the filling station and the preparatory station, a control command of "waiting for filling" is given.

If the container is found at the filling station with no container found at the preparatory station, or if the presence of container is detected at both the stations, a control command of "usual filling" is given.

When no container is found at the filling station with the presence of container detected at the preparatory station, a control command of "idle filling" is given.

Although the presence or absence of the container is detected at the starting end of the path of transport by the conveyor, the operation of detecting the presence or absence of the container C is conducted at each of the filling station and the preparatory station by a first sensor 91 and a second sensor 92 located at each of the filling station and the preparatory station.

What is claimed is:

1. A liquid metering-filling apparatus comprising:

a container transport conveyor intermittently drivable so as to halt containers one by one at a filling station;

a filling nozzle disposed above a path of transport of containers at said filling station;

a metering cylinder housing a piston and having an outlet in communication with said filling nozzle;

an inlet check valve provided at an inlet of said metering cylinder;

an outlet check valve provided at any one of said outlet of said metering cylinder and inside said filling nozzle;

drive means for causing said piston to perform a cycle of stroking movement every time said conveyor is driven by one pitch;

a first sensor means for detecting any one of a presence and an absence of a container of said containers at said filling station;

a second sensor means for detecting any one of a presence and an absence of a container of said containers at said stop station immediately preceding said filling station upstream therefrom; and valve opening-closing means for opening said inlet check valve upon said first sensor means detecting said absence of a container of said containers and said second sensor means detecting said presence of a container of said containers.

2. The liquid metering-filling apparatus as defined in claim 1, further comprising means for controlling said drive means so as to stop operation of said drive means upon said first sensor means detecting said absence of a container of said containers and said second sensor means detecting said absence of a container of said containers.

3. A liquid metering-filling apparatus comprising:

a container transport conveyor intermittently drivable so as to halt containers one by one at a filing station;

a filing nozzle disposed above a path of transport of said containers at said filling station;

a metering cylinder housing a piston and having an outlet in communication with said filling nozzle;

an inlet check valve provided at an inlet of said metering cylinder;

an outlet check valve provided at any one of said outlet of said metering cylinder and inside of said filling nozzle, and drive means for causing said piston to perform a cycle of stroking movement every time said conveyor is driven by one pitch;

sensor means for detecting any one of a presence and an absence of a container of said containers at a stop station at least two stations preceding said filling station upstream therefrom;

a determining means for determining any one of said presence and said absence of a container of said containers at said filling station and simultaneously determining any one of said presence and said absence of a container of said containers at said stop station immediately proceeding said filling station upstream therefrom by means of storing a value detected by said sensor means as data and reading out corresponding data; and valve opening-closing means for opening said inlet check valve upon said determining means determining any one of said presence and said absence of a container of said containers at said filling station and said sensor means detecting any one of said presence of a container of said containers at said stop station immediately preceding said filling station upstream therefrom.

4. The liquid metering-filling apparatus as defined in claim 3, further comprising a control means for controlling said drive means to stop operation of said drive means upon said determining means determining said absence of a container of said containers at said filing station and also determining said absence of a container of said containers at said stop station immediately preceding said filling station upstream therefrom.

5. The liquid metering-filling apparatus as defined in claim 3, wherein said valve opening-closing means is also for forcedly closing said outlet check valve while said inlet check valve is open.

6. The liquid metering-filling apparatus as defined in claim 3, wherein said drive means comprises a pivotal cam follower having a drive arm and a driven arm with a first end of said drive arm connected to said piston, a plate cam having a cam contour face adapted for bearing contact with a first end of said driven arm, a hydraulic cylinder having a piston rod for biasing said cam follower so as to move said first end of said driven arm toward said cam contour face when said piston rod is retracted and to move said first end of said driven arm away from said cam contour face when said piston rod is advanced, and a stopper permitting a required portion of said cam follower to come into contact with said stopper when said cam follower is pivotally moved in a direction in which said first end of said driven arm end moves away from said cam contour face, said first end of said driven arm being any one of in contact with and spaced apart from, by a small clearance, a portion of said cam contour face having a largest radius when said cam follower is in contact with said stopper, said control means being operable in a manner so that said piston rod is retracted when said drive means is operated and so that said piston rod is advanced when said drive means is brought out of operation.

* * * * *